US006241138B1

(12) United States Patent
Garrigan et al.

(10) Patent No.: US 6,241,138 B1
(45) Date of Patent: Jun. 5, 2001

(54) PAPER WEB THREADING APPARATUS AND METHOD FOR THREADING A PAPER WEB THROUGH A PAPERMAKING MACHINE

(75) Inventors: Bruce G. Garrigan, Green Bay; Patrick J. Theut, Tomahawk; Michael C. Wozniak, De Pere, all of WI (US)

(73) Assignee: C. A. Lawton, DePere, WI (US)

( * ) Notice: Subject to any disclaimer, the term of this patent is extended or adjusted under 35 U.S.C. 154(b) by 0 days.

(21) Appl. No.: 09/432,004

(22) Filed: Nov. 2, 1999

(51) Int. Cl.[7] ..... G03B 1/56; D06F 58/00; D21F 1/36

(52) U.S. Cl. ..... 226/92; 34/120; 162/193

(58) Field of Search ..... 226/91, 92; 34/117, 34/120; 162/193

(56) References Cited

U.S. PATENT DOCUMENTS

| | | | | |
|---|---|---|---|---|
| 1,688,267 | * | 10/1928 | Cram | 162/193 |
| 3,529,755 | * | 9/1970 | Spangenberg et al. | 226/92 X |
| 4,480,801 | * | 11/1984 | Stone | 226/92 X |
| 4,747,254 | | 5/1988 | Lancaster . | |
| 4,931,141 | * | 6/1990 | Shafranski | 162/193 X |
| 5,016,831 | | 5/1991 | Saukkonen . | |
| 5,184,408 | * | 2/1993 | Kotitschke et al. | 34/117 |
| 5,255,602 | * | 10/1993 | Mamberer et al. | 226/92 X |
| 5,263,623 | | 11/1993 | Bracken . | |
| 5,375,753 | | 12/1994 | Barthauer et al. . | |
| 5,377,892 | | 1/1995 | Kimball . | |
| 5,379,932 | | 1/1995 | Bracken . | |
| 5,397,044 | | 3/1995 | Suzuki . | |

OTHER PUBLICATIONS

Article entitled "What you should know about rope systems and automatic transfers", Diltz et al., *PIMA*, May 1988.

* cited by examiner

*Primary Examiner*—Michael R. Mansen
(74) *Attorney, Agent, or Firm*—Sonnenschein Nath & Rosenthal

(57) ABSTRACT

A paper web threading apparatus is provided for a papermaking machine. The threading apparatus includes a transfer sheave assembly mounted on an end of a middle rotating drum disposed between an upstream drum and a downstream drum. The transfer sheave assembly includes a first sheave that is fixed to the middle drum and rotates with the middle drum and a second sheave that rotates freely and independently of the middle drum. An upstream pair of endless ropes is provided that wrap partially around the sheave of the upstream drum before wrapping partially around one of the sheaves of the transfer sheave assembly. A pair of downstream endless ropes is also provided that wrap partially around the other of the sheaves of the transfer sheave assembly as well as the sheave mounted to the downstream drum. The upstream ropes maintain an adjacent position with respect to each other until they depart from the transfer sheave assembly. The downstream ropes maintain a diverged positional relationship with respect to each other until they engage the transfer sheave assembly and form a nip point. Thus, the upstream pair of endless ropes maintain a closely adjacent positional relationship until they pass the nip point. As a result, the tail or leading edge of a paper web can be effectively transferred from the upstream pair of endless ropes to the downstream pair of endless ropes.

17 Claims, 4 Drawing Sheets

PAPER WEB THREADING APPARATUS AND METHOD FOR THREADING A PAPER WEB THROUGH A PAPERMAKING MACHINE

FIELD OF THE INVENTION

The present invention relates generally to a paper web threading apparatus and, more specifically, to an apparatus for threading a leading edge of a paper web through a series of rollers or rotating cans of a papermaking machine. Further, the present invention relates to a method for threading a leading edge of a paper web through a series of rollers or rotating cans of a papermaking machine.

BACKGROUND OF THE INVENTION

Papermaking machines consist of several sections such as the fourdrinier, press section, dryer sections, calendar section, a reel, as well as other sections that may be unique to a particular type or grade of paper being produced. Many of these sections consist of multiple rolls or "cans" over which the paper travels. To start a new paper sheet or web through the papermaking machine, ropes can be used to carry a narrow leading edge of the web of paper, commonly referred to as a "tail" through the rollers. At a junction of two sections, the tail must be transferred from one set of ropes to another. This procedure is illustrated in FIGS. 1–3.

Specifically, FIG. 1 is a top plan view of two adjacent dryer sections 10, 12 of a papermaking machine 14. To feed the new paper web 16 through the dryer sections 10, 12, the web 16 is provided with a tail 18 or a narrow leading edge as illustrated. The tail is inserted between two endless ropes 20, 22 that are wrapped partially around sheaves disposed at the ends of the dryer cans 24, 26 as well as the sheaves 28, 30 as shown in FIGS. 1 and 3. The upstream endless ropes 20, 22 must carry the tail 18 to the nip 32 formed by the two endless ropes 34, 36 that extend around the sheaves 38, 40, 42 as well as sheaves mounted at the ends of the dryer cans 44, 46 as also shown in FIGS. 1 and 3. Not shown in FIGS. 1 and 3 are stretching apparatuses used to adjust the tension of the endless ropes 20, 22 and 34, 36. Such stretching apparatuses are known in the art. Examples of such stretching apparatuses appear in U.S. Pat. Nos. 5,263,623, 5,375,753, 5,377,892 and 5,379,932. The sheaves mounted to the ends of the cans 24, 26, 44, 46 are also not shown but such sheaves are known in the art and are mounted to the can or roll head and rotate with the can or roll. The flow of the paper web 16 is illustrated in FIG. 2.

It will be noted that the downstream section 12 (cans 44, 46) can be operated at a higher speed than the upstream section (cans 24, 26) to apply an appropriate tension to the paper web 16.

The primary disadvantage with the tail transfer system illustrated in FIGS. 1–3 is the premature release of the tail 18 by the ropes 20, 22. Specifically, referring to FIG. 3, the ropes 20, 22 separate or diverge prior to reaching the nip 32 or the can 44. As a result, the tail 18 is released too early and towards the inside or the center of the papermaking machine before the downstream ropes 34, 36 form the nip 32 and can carry the tail 18 further downstream past the cans 44, 46.

As a result, there is a need for an improved web threading apparatus and method which does not result in a high incidence of the tail being released prematurely by the upstream ropes prior to the formation of the nip by the downstream ropes or a premature release by the upstream ropes which results in the tail being released inside towards the center of the papermaking machine.

SUMMARY OF THE INVENTION

The present invention satisfies the aforenoted needs by providing a paper web threading apparatus for use in a papermaking machine. The threading apparatus is applicable to a papermaking machine including a plurality of rotating drums such as an upstream drum, a downstream drum and a middle drum disposed between the upstream and downstream drums. Each drum includes an end on which a sheave is mounted. In an embodiment, a transfer sheave assembly is mounted on the end of the middle drum. The transfer sheave assembly includes a first sheave attached to the middle drum and that rotates with the middle drum and a second sheave that rotates freely and independently of the middle drum. The transfer sheave assembly also includes at least four endless ropes including at least two upstream ropes and at least two downstream ropes. The upstream ropes extend adjacent to one another and wrap partially around the sheave of the upstream drum before wrapping partially around one of the first or second sheaves of the transfer sheave assembly before diverging from one another downstream of the transfer sheave assembly. The downstream ropes are spaced laterally divergent from one another before converging in assuming adjacent positions with respect to each other and wrapping partially around the other of the first or second sheaves of the transfer sheave assembly before wrapping partially around the sheave of the downstream drum.

In an embodiment, the middle drum is the last drum of an upstream section of the papermaking machine and the downstream drum is the first drum of a downstream section of the papermaking machine. In this embodiment, the downstream section is operated at a higher speed than the upstream section. Therefore, the downstream ropes are mounted to the second sheave of the transfer sheave assembly which rotates freely and independently of the middle drum. Because the middle drum is the last drum of an upstream section, it rotates at a slower speed than the downstream section. Accordingly, the upstream ropes wrap around the first sheave which rotates at the same speed as the middle drum and the downstream ropes wrap around the second sheave which is free wheeling and therefore free to rotate at the higher speed of the downstream section. In this embodiment, the second or free wheeling sheave is disposed between the first sheave and the end of the middle drum.

In an alternative embodiment, the upstream drum is the last drum of an upstream section of the papermaking machine and the middle drum is the first drum of a downstream section of the papermaking machine. Thus, the middle drum and the downstream section rotate at a faster speed than the upstream drum and the upstream section of the papermaking machine. As a result, the downstream ropes wrap around the first sheave of the transfer sheave assembly which rotates at the same speed as the middle drum and the upstream ropes wrap partially around the second sheave of the transfer sheave assembly which is free wheeling and therefore is free to rotate at the slower speed of the upstream section. In this embodiment, the first sheave or the sheave fixed to the middle drum is preferably disposed between the second free wheeling sheave and the end of the drum.

In an embodiment, the upstream ropes also pass through a stretcher.

In an embodiment, the downstream ropes also pass through a stretcher.

In an embodiment, the present invention provides a method for threading the leading edge of a paper web through a papermaking machine as described above. The method includes the steps of providing a web threading apparatus as described above, operating the downstream section at a higher speed than the upstream section, and inserting the leading edge of the tail between the upstream ropes at a point upstream of the transfer sheave assembly.

Additional features and advantages of the present invention are described in, and will be apparent from, the detailed description of the presently preferred embodiments and from the drawings.

BRIEF DESCRIPTION OF THE DRAWINGS

For a more complete understanding of the present invention, reference should now be made to the embodiments illustrated in greater detail in the accompanying drawings, described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
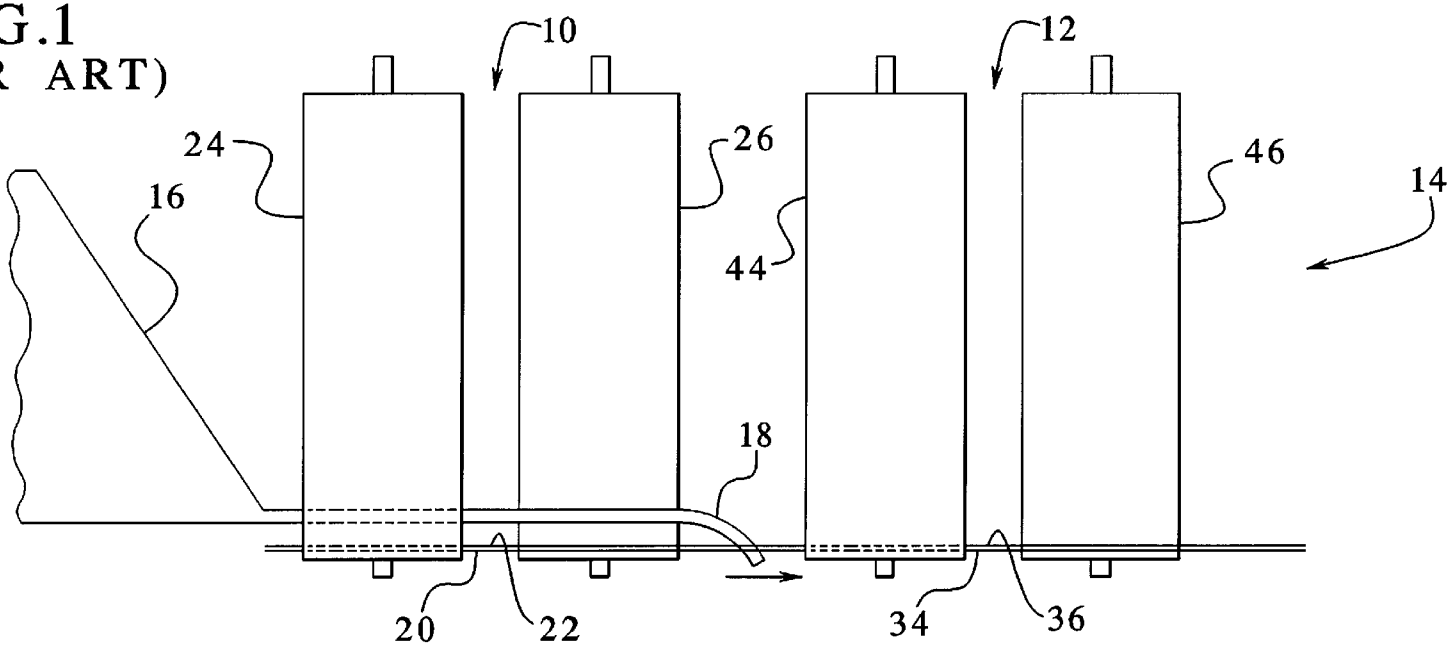
FIG.1 (PRIOR ART)
FIG. 1 is a top plan view of a papermaking machine known in the art, particularly illustrating the threading of a tail or leading edge of a paper web through the machine.
Figure 6:
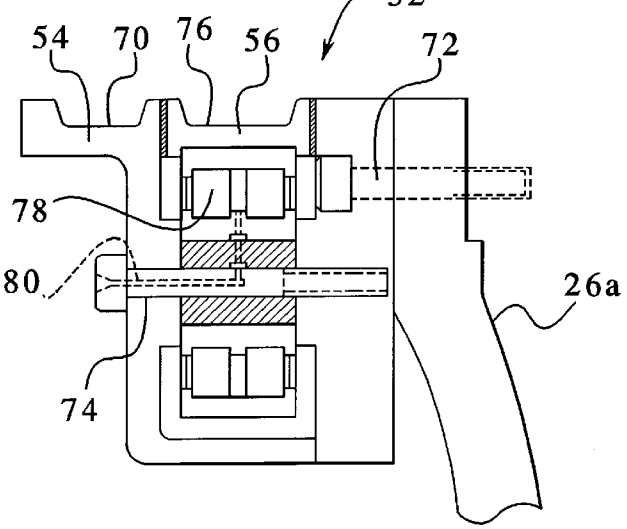
FIG. 6 is a partial side sectional view of the transfer sheave assembly employed with the embodiment illustrated in FIG. 4.
Figure 4:
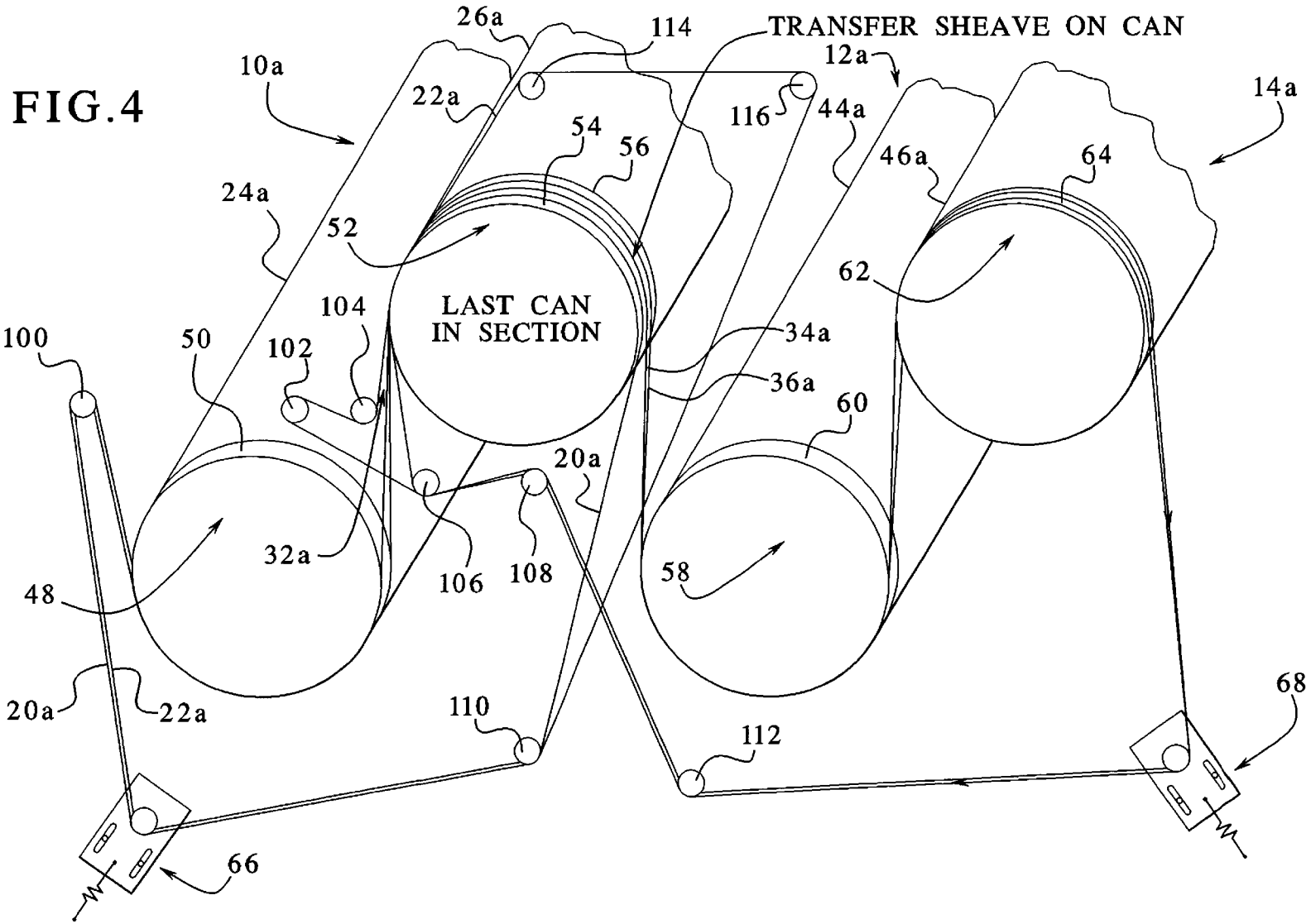
FIG. 4 is a schematic illustration of a paper web threading apparatus made in accordance with the present invention as installed on a papermaking machine and, more particularly, wherein the transfer sheave assembly is installed on the last drum or can of an upstream section of a papermaking machine.

Referring first to FIG. 4, an upstream section 10*a* and a downstream section 12*a* of a papermaking machine 14*a* are illustrated schematically. The upstream section 10*a* includes cans or drums 24*a* and 26*a*. The can 24*a* is equipped with a sheave 48 mounted on one end thereof which includes a single groove 50 for accommodating the two upstream ropes 20*a*, 22*a*. The drum or can 26*a* is equipped with a transfer sheave assembly 52 which includes not one, but two sheaves 54, 56 as shown in FIG. 6. The outer sheave 54 is fixed to the drum 26*a* as shown in FIG. 6 and the inner sheave 56 is free wheeling and therefore not fixed to the drum 26*a*. The sheave 54 accommodates the upstream ropes 20*a*, 22*a*. The inner free wheeling sheave 56 accommodates the downstream ropes 34*a*, 36*a*. The free wheeling sheave 56 must accommodate the downstream ropes 34*a*, 36*a* because the downstream ropes 34*a*, 36*a* move at the same speed as the drums 44*a*, 46*a* of the downstream section 12*a*. The downstream drums 44*a*, 46*a* operate at a faster speed than the upstream drums 24*a*, 26*a* in order to apply tension to the paper web 16 (not shown in FIG. 4; see FIG. 1). From the transfer sheave assembly 52, the downstream ropes 34*a*, 36*a* wrap partially around the sheave 58 which is mounted to an end of the drum 44*a* and which includes a single groove 60 before wrapping partially around the sheave 62 mounted on the end of the drum 46*a* and which includes a single groove 64.

Figure 2:
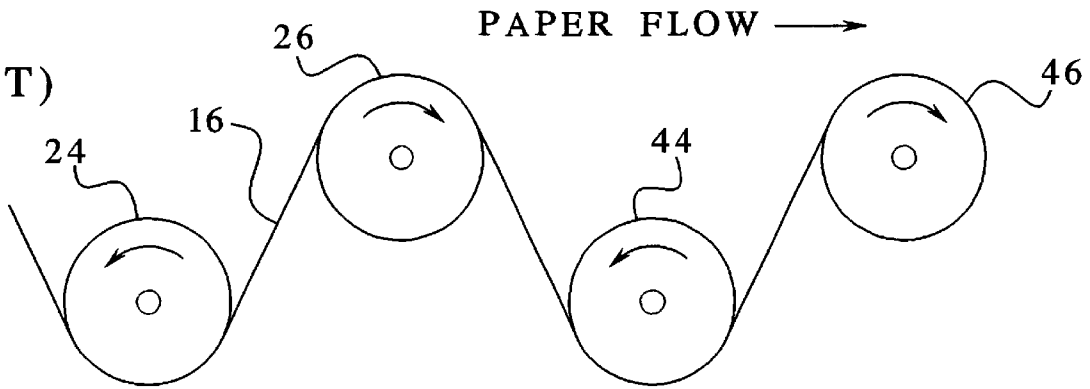
FIG.2 (PRIOR ART)
FIG. 2 is a front elevational view of the papermaking machine illustrated in FIG. 1, particularly illustrating the flow of the paper web through the machine.
Figure 3:
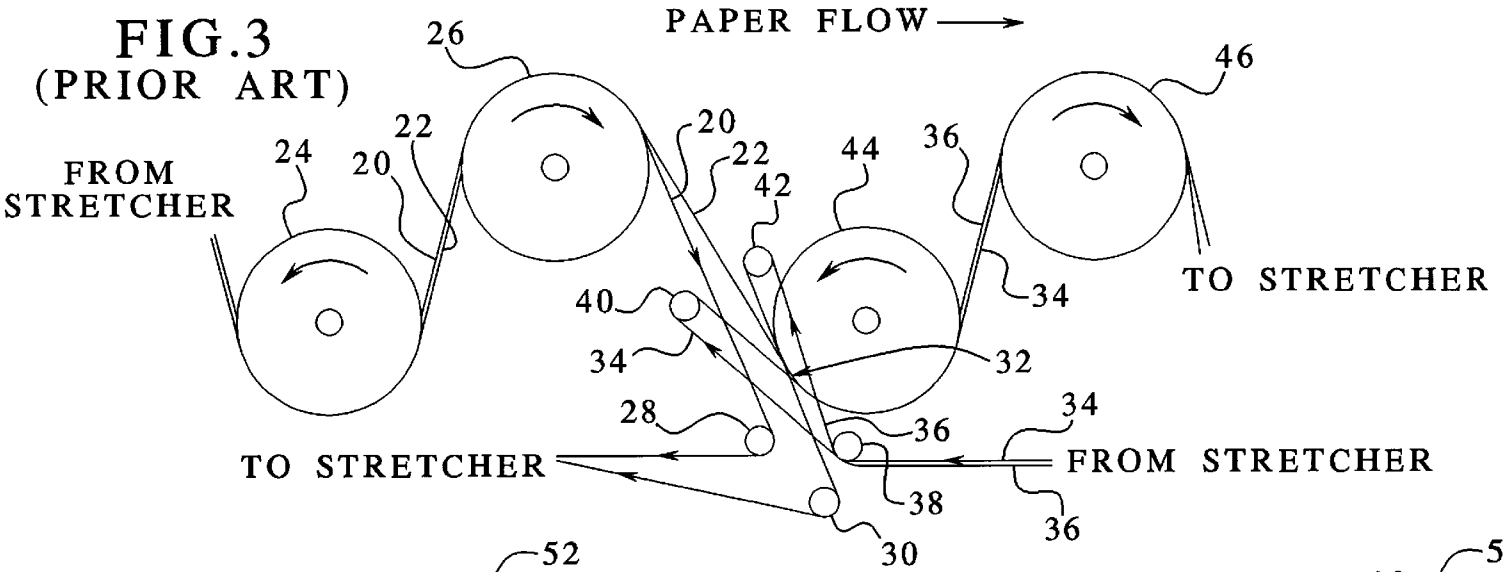
FIG.3 (PRIOR ART)
FIG. 3 is a schematic illustration of a prior art threading apparatus as applied to the papermaking machine illustrated in FIGS. 1 and 2.

Stretching mechanisms 66, 68 are employed to adjust the tension to the upstream ropes 20*a*, 22*a* and downstream ropes 34*a*, 36*a* respectively. The nip point 32*a* is formed when the downstream ropes 34*a*, 36*a* come together in an adjacent position at the transfer sheave assembly 52 as shown in FIG. 4. It will be noted that the upstream ropes 20*a*, 22*a* remain in an adjacent position with respect to each other through the nip point 32*a* and engage the transfer sheave assembly 52 while remaining in the adjacent position. Thus, when the tail 18 of the paper web 16 (see FIG. 1) is inserted between the upstream ropes 20*a*, 22*a*, the upstream ropes 20*a*, 22*a* are able to safely carry the tail 18 to the nip point 32*a* as shown in FIG. 4 without the premature release that occurs with the system illustrated in FIGS. 1–3.

As shown in FIG. 6, the transfer sheave assembly 52 includes an outer sheave 54 with a single groove 70 that accommodates both upstream ropes 20*a*, 22*a*. The sheave 54 is fixed to the last drum 26*a* of the upstream section by way of the bolts 72, 74. The sheave 56 includes a single groove 76 for accommodating the downstream ropes 34*a*, 36*a*. The inner free-wheeling sheave 56 may ride on a plurality of bearings 78, a single bearing, a plurality of balls, or a plurality of rollers (not shown). Lubrication of the bearings may be provided through the passageway 80.

The stretching mechanisms 66, 68 are only shown schematically. Again, stretching mechanisms are known in the art and illustrated in U.S. Pat. Nos. 5,263,623, 5,375,753, 5,377,892 and 5,379,932, which disclosures are incorporated herein by reference.

Figure 5:
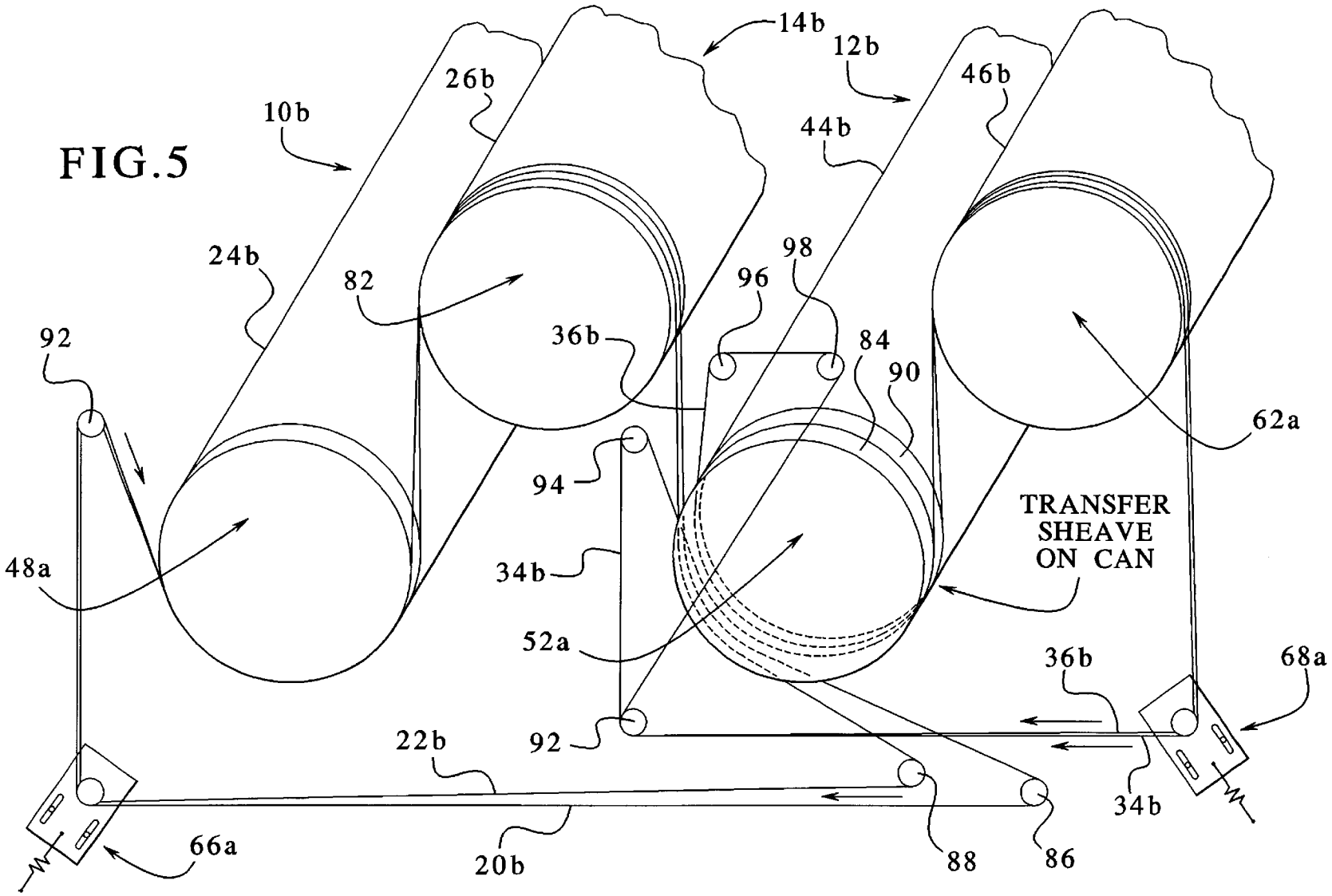
FIG. 5 is a schematic illustration of a paper web threading apparatus made in accordance with the present invention as installed on a papermaking machine and, more particulary, wherein the transfer sheave assembly is installed on the first drum or can of a downstream section of the papermaking machine.

Turning to FIG. 5, the transfer sheave assembly 52*a* is mounted on an end of the first drum 44*b* of the downstream section 12*b* instead of the last drum of the upstream section as illustrated in FIG. 4. In this embodiment, the upstream ropes 20*b*, 22*b* extend around the sheave 48*a* mounted on the end of the drum 24*b* and the sheave 82 mounted on the end of the drum 26*b* before extending towards the transfer sheave assembly 52*a*. The upstream ropes 20*b*, 22*b* maintain an adjacent aligned position until they engage the outer free wheeling sheave of the transfer sheave assembly 52*a* (see FIG. 7). The upstream ropes 20*b*, 22*b* do not diverge until they disengage from the transfer sheave assembly 52*a* and wrap around the sheaves 86, 88 respectively. The downstream ropes 34*b*, 36*b* maintain a diverged or separated position until they engage the transfer sheave assembly 52*a*, and more specifically, the inner fixed sheave 90 of the transfer sheave assembly 52*a* (see FIG. 7) before engaging the sheave 62*a* mounted on the end of the drum 46*b*. The downstream ropes must engage the fixed sheave 90 because they travel at the same higher speed as the drums 44*b*, 46*b* of the downstream section 12*b*. In contrast, the upstream ropes 20*b*, 22*b* must engage the free wheeling outer sheave

84 because they travel at the slower speed of the drums 24*b*, 26*b* of the upstream section 10*b*. The sheave 90 may be an integral part of the drum 44*b*.

Again, stretching mechanisms 66*a*, 68*a* are shown schematically. Further, it will be noted that the positions of the sheaves 92, 94, 96, 98 will vary depending upon the design of the papermaking machine 14*b*. Similarly, referring back to FIG. 4, the positions of the sheaves 100, 102, 104, 106, 108, 110, 112, 114 and 116 can and also will vary depending upon the design of the papermaking machine 14*a*.

Figure 7:
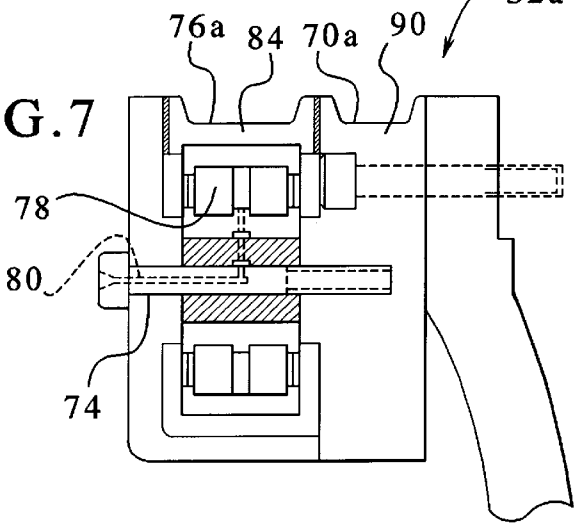
FIG. 7 is a partial side sectional view of the transfer sheave assembly employed with the embodiment illustrated in FIG. 5.

Turning to FIG. 7, the outer free wheeling sheave 84 also includes a single groove 76*a* for accommodating the upstream ropes 20*b*, 22*b*. The inner fixed sheave 90 includes a single groove 70*a* for accommodating the downstream ropes 34*b*, 36*b*. The free wheeling outer sheave 84 is mounted on a plurality of bearings 78*a* which may be lubricated by way of the passageway 80*a* provided in the bolt 74*a*.

It will be noted that the invention is applicable to the press section, calendar section, coaters, reel and off-machine coaters of papermaking machines in addition to the dryer section of papermaking machines.

Furthermore, it should also be understood that other various changes and modifications to the presently preferred embodiments described herein will be apparent to those skilled in the art. Such changes and modifications may be made without departing from the spirit and scope of the present invention and without diminishing its attendant advantages. Therefore, it is intended that such changes and modifications be covered by the appended claims.

We claim:

1. A paper web threading apparatus for use with a papermaking machine including a plurality of rotating drums including an upstream drum, a downstream drum and a middle drum disposed therebetween, each drum including an end, the upstream drum including a sheave mounted on the end thereof, the downstream drum including a sheave mounted on the end thereof, the apparatus comprising:

a transfer sheave assembly mounted on the end of the middle drum, the transfer sheave assembly comprising a first sheave attached to the middle drum that rotates with the middle drum and a second sheave that rotates freely and independently of the middle drum, at least four endless ropes including at least two upstream ropes and at least two downstream ropes, the upstream ropes extending adjacent to one another and wrapping partially around the sheave of the upstream drum before wrapping partially around one of the first or second sheaves of the transfer sheave assembly before diverging from one another downstream of the transfer sheave assembly, the downstream ropes being spaced laterally divergent from one another before converging and assuming adjacent positions with respect to each other and wrapping partially around the other of the first or second sheaves of the transfer sheave assembly before wrapping partially around the sheave of the downstream drum.

2. The paper web threading apparatus of claim 1 wherein the middle drum is the last drum of an upstream section of the papermaking machine and the downstream drum is the first drum of a downstream section of the papermaking machine, and wherein the second sheave of the transfer sheave assembly is disposed between the first sheave and the end of the middle drum, and wherein the upstream ropes wrap partially around the first sheave and the downstream ropes wrap partially around the second sheave.

3. The paper web threading apparatus of claim 1 wherein the upstream drum is the last drum of an upstream section of the papermaking machine and the middle drum is the first drum of a downstream section of the papermaking machine, and wherein the first sheave of the transfer sheave assembly is disposed between the second sheave and the end of the middle drum, and wherein the downstream ropes wrap partially around the first sheave and the upstream ropes wrap partially around the second sheave.

4. The paper web threading apparatus of claim 1 wherein the upstream ropes pass through a stretcher.

5. The paper web threading apparatus of claim 1 wherein the downstream ropes pass through a stretcher.

6. A paper web threading apparatus for use with a papermaking machine including a plurality of sections including an upstream section and a downstream section, the upstream section including a plurality of rotating drums including an upstream drum disposed upstream of a last drum of the upstream section, the downstream section including a downstream drum wherein the last drum of the upstream section is disposed between the upstream drum of the upstream section and the downstream drum of the downstream section, each drum including an end, the upstream drum including a sheave mounted to the end thereof, the downstream drum including a sheave mounted to the end thereof, the apparatus comprising:

a transfer sheave assembly mounted on the end of the last drum of the upstream section, the transfer sheave assembly comprising a first sheave attached to the last drum that rotates with the last drum, a second sheave that rotates freely and independently of the last drum, the second sheave being disposed between the first sheave and the end of the last drum, at least four endless ropes including at least two upstream ropes and at least two downstream ropes, the upstream ropes extending adjacent to one another and wrapping partially around the sheave of the upstream drum before wrapping partially around the first sheave of the transfer sheave assembly before diverging from one another downstream of the transfer sheave assembly, the downstream ropes being spaced laterally divergent from one another before converging and assuming adjacent positions with respect to each other and wrapping partially around the second sheave of the transfer sheave assembly before wrapping partially around the sheave of the downstream drum.

7. The paper web threading apparatus of claim 6 wherein the upstream ropes pass through a stretcher.

8. The paper web threading apparatus of claim 6 wherein the downstream ropes pass through a stretcher.

9. A paper web threading apparatus for use with a papermaking machine including a plurality of sections including an upstream section and a downstream section, the upstream section including an upstream drum, the downstream section including a first drum and a downstream drum wherein the first drum of the downstream section is disposed between the upstream drum of the upstream section and the downstream drum of the downstream section, each drum including an end, the upstream drum including a sheave mounted to the end thereof, the downstream drum including a sheave mounted to the end thereof, the apparatus comprising:

a transfer sheave assembly mounted on the end of the first drum of the downstream section, the transfer sheave assembly comprising a first sheave attached to the first drum that rotates with the first drum, a second sheave that rotates freely and independently of the first drum, the first sheave being disposed between the second sheave and the end of the first drum, at least four endless ropes including at least two upstream ropes and at least two downstream ropes, the upstream ropes extending adjacent to one another and wrapping partially around the sheave of the upstream drum before wrapping partially around the second sheave of the transfer sheave assembly before diverging from one another downstream of the transfer sheave assembly, the downstream ropes being spaced laterally divergent from one another before converging and assuming adjacent positions with respect to each other and wrapping partially around the first sheave of the transfer sheave assembly before wrapping partially around the sheave of the downstream drum.

10. The paper web threading apparatus of claim 9 wherein the upstream ropes pass through a stretcher.

11. The paper web threading apparatus of claim 9 wherein the downstream ropes pass through a stretcher.

12. A method for threading a leading edge of a paper web through a papermaking machine that includes a plurality sections including an upstream section and a downstream section, the upstream section including a plurality of rotating drums including an upstream drum disposed upstream of a last drum of the upstream section, the downstream section including a downstream drum wherein the last drum of the upstream section is disposed between the upstream drum of the upstream section and the downstream drum of the downstream section, each drum including an end, the upstream drum including a sheave mounted to the end thereof, the downstream drum including a sheave mounted to the end thereof, the method comprising the following steps:

providing a web threading apparatus comprising a transfer sheave assembly mounted on the end of the last drum of the upstream section, the transfer sheave assembly comprising a first sheave attached to the last drum that rotates with the last drum, a second sheave that rotates freely and independently of the last drum, the second sheave being disposed between the first sheave and the end of the last drum, at least four endless ropes including at least two upstream ropes and at least two downstream ropes, the upstream ropes extending adjacent to one another and wrapping partially around the sheave of the upstream drum before wrapping partially around the first sheave of the transfer sheave assembly before diverging from one another downstream of the transfer sheave assembly, the downstream ropes being spaced laterally divergent from one another before converging and assuming adjacent positions with respect to each other and wrapping partially around the second sheave of the transfer sheave assembly before wrapping partially around the sheave of the downstream drum;

operating the downstream section at a higher speed than the upstream section; and inserting the leading edge of the tail between the upstream ropes at a point upstream of the transfer sheave assembly.

13. The method of claim 12 wherein the upstream ropes pass through a stretcher.

14. The method of claim 12 wherein the downstream ropes pass through a stretcher.

15. A method for threading a leading edge of a paper web through a papermaking machine that includes a plurality of sections including an upstream section and a downstream section, the upstream section including an upstream drum, the downstream section including a first drum and a downstream drum wherein the first drum of the downstream section is disposed between the upstream drum of the upstream section and the downstream drum of the downstream section, each drum including an end, the upstream drum including a sheave mounted to the end thereof, the downstream drum including a sheave mounted to the end thereof, the method comprising the following steps:

providing a web threading apparatus comprising a transfer sheave assembly mounted on the end of the first drum of the downstream section, the transfer sheave assembly comprising a first sheave attached to the first drum that rotates with the first drum a second sheave that rotates freely and independently of the first drum, the first sheave being disposed between the second sheave and the end of the first drum, at least four endless ropes including at least two upstream ropes and at least two downstream ropes, the upstream ropes extending adjacent to one another and wrapping partially around the sheave of the upstream drum before wrapping partially around the second sheave of the transfer sheave assembly before diverging from one another downstream of the transfer sheave assembly, the downstream ropes being spaced laterally divergent from one another before converging and assuming adjacent positions with respect to each other and wrapping partially around the first sheave of the transfer sheave assembly before wrapping partially around the sheave of the downstream drum;

operating the downstream section at a higher speed than the upstream section; and inserting the leading edge of the tail between the upstream ropes at a point upstream of the transfer sheave assembly.

16. The method of claim 15 wherein the upstream ropes pass through a stretcher.

17. The method of claim 15 wherein the downstream ropes pass through a stretcher.

* * * * *